US005085433A

United States Patent [19]

Parsons

[11] Patent Number: 5,085,433

[45] Date of Patent: Feb. 4, 1992

[54] AUXILIARY FOLDING HANDLE

[75] Inventor: Kevin L. Parsons, Appleton, Wis.

[73] Assignee: Armament Systems & Procedures, Inc., Appleton, Wis.

[21] Appl. No.: 686,650

[22] Filed: Apr. 17, 1991

[51] Int. Cl.[5] ..... F41B 15/02

[52] U.S. Cl. ..... 273/84 R; 42/1.16; 42/75.01

[58] Field of Search ..... 273/84 R; 42/1.16, 75.01

[56] References Cited

U.S. PATENT DOCUMENTS

| | | | |
|---|---|---|---|
| D. 230,150 | 1/1974 | Anderson | 273/84 R X |
| 4,037,839 | 7/1977 | Nelson | 273/84 R |
| 4,132,409 | 1/1979 | Taylor | 273/84 R |
| 4,355,804 | 10/1982 | Bingham | 273/84 R |
| 4,408,410 | 10/1983 | A'Costa | 273/84 R X |
| 4,479,171 | 10/1984 | Mains | 362/102 |
| 4,752,072 | 6/1988 | Parsons | 273/84 R |
| 4,842,277 | 6/1989 | La Croix | 273/84 ES |

*Primary Examiner*—William H. Grieb

*Attorney, Agent, or Firm*—Andrus, Sceales, Starke & Sawall

[57] ABSTRACT

An auxiliary folding handle for a police baton, club or tactical firearm is described. The auxiliary folding handle includes a mechanism allowing the handle to fold along side the shaft of the baton, club or firearm when the handle is not in use. The handle may be rotated perpendicularly to a position which allows the handle to be releasibly locked in place for use.

18 Claims, 5 Drawing Sheets

AUXILIARY FOLDING HANDLE

FIELD OF THE INVENTION

The present invention is directed to an auxiliary handle for an impact weapon such as a baton, e.g., a policeman's baton, club or tactical firearm. The present invention relates more specifically to a folding auxiliary handle for a policeman's baton or the like.

DESCRIPTION OF THE PRIOR ART

A policeman's baton is a well-known weapon for use in law enforcement. A standard policeman's baton includes a straight, generally cylindrical shaft with a hand grip at one end and a striking surface at the other end.

The standard baton can be modified by adding an auxiliary right-angle handle about one-fourth of the distance from the hand grip end. The auxiliary handle, also known as a side handle, crosshandle or a "Yawara" handle, improves the effectiveness of the policeman's baton by allowing new procedures not able to be performed with a standard straight baton. In use, the baton is gripped by the auxiliary handle when swinging in a generally horizontal plane. During the swinging motion, the grip is loosened sufficiently to permit the side handle to rotate within the hand. The baton shaft thus achieves a significantly greater velocity during the swing stroke.

One style of this baton is illustrated in U.S. Pat. No. Des. 230,150. Taylor U.S. Pat. No. 4,132,409, entitled "Police Baton With Rotatable Crosshandle," discloses a baton with a rotatable sleeve on the crosshandle. This permits greater spin without requiring a loosened grip. La Croix U.S. Pat. No. 4,842,277, entitled "Multi-Purpose Baton," discloses a policeman's baton having an electrical deterrent charge. Maines U.S. Pat. No. 4,479,171, entitled "Side Arm Baton and Flashlight," discloses a policeman's baton which also doubles as a flashlight.

Although the concept of the auxiliary handle is known to the art, there are some deficiencies which should be addressed. For example, the auxiliary handles of the prior art are all attached to the shaft of the baton in a manner such that the auxiliary handle maintains a rigid perpendicular position with respect to the baton shaft. While the baton is still effective as a combat weapon, the rigid outwardly extending position of the auxiliary handle makes is difficult to conceal the baton. This can be detrimental especially for plain-clothes operations, which require a concealed weapon.

SUMMARY OF THE INVENTION

Briefly stated, the present invention is directed to an auxiliary folding handle attachment for a police baton, club, firearm or other instrument which includes an elongated shaft. The folding handle attachment includes a handle having a first end for fitting against the shaft, a second exterior end, and an axially aligned bore extending through the handle. A rod is centrally disposed within the bore of the handle. The rod includes a stationary mounting post with a first end for fitting against the shaft and a second end to which is hingedly attached a handle post. The handle post includes a first end which, together with the second end of the mounting post, forms a hinge for folding the handle post at an approximately 90° angle with respect to the mounting post. The handle post further includes a second end for securing the handle to the rod. The handle attachment also includes a lock for releasibly locking the handle attachment to the elongated shaft at a position perpendicular to the elongated shaft. The handle is generally saddle-shaped at the first end for mating the handle attachment against the shaft.

It is also within the scope of the present invention to provide a system for attaching the auxiliary folding handle to a baton. The folding handle may be temporarily attached, as by a screw passing through the elongated shaft of the baton and into the folding handle apparatus; or it may be permanently attached to the elongated shaft, as by welding, gluing or other means known to the art.

There are several advantages to the embodiment of the present invention. First, the handle will fold in a compact manner to lie against the elongated shaft of the baton. Thus, it will be easier to conceal the baton.

The folding handle is also biased against the shaft so that it will resist swinging open to its perpendicular "use" position until the operator actually rotates the handle. In this manner the folded handle will not freely swing on its hinged axis. Additionally, the folded structure creates a retainer clip for securing the baton to a belt or the like.

Another advantage is that the hand grip folds naturally against the elongated shaft of the baton in a manner so that it can be easily opened. There is no locking mechanism which must be released in order to open the handle to its perpendicular "ready-to-be-used" position without requiring a lock-release mechanism. By means of a lock associated with the hinge, the now-opened auxiliary handle will lock into position automatically and cannot be released unless and until the lock release mechanism is activated.

The police batons of the present invention are used especially in plain-clothes situations when a baton needs to be concealed until it is required. It can then be conveniently hidden because it folds into a compact shape.

The auxiliary folding handle has other applications beyond the use in a police baton. For example, the auxiliary folding handle is useful for firearms and especially tactical firearm weapons, such as short-barrelled shotguns, assault rifles and submachine guns. One of the problems with tactical weapons of this nature is that the design of the barrel places the operator's forward hand near the muzzle during rapid fire use. The user's hand may be inadvertently placed in front of the muzzle of the firearm. If the weapon is then fired, the user may lose a portion of his hand. With the addition of an auxiliary folding handle, the user's positioning and leveling hand will automatically seek the folding handle thereby preventing him from inadvertently placing his hand in a position of danger.

Further objects, features and advantages of the invention will be apparent from the following detailed description when taken in conjunction with the accompanying drawings.

DETAILED DESCRIPTION OF THE INVENTION

Reference is now made to the figures in which like features will receive the same reference numbers.

Figure 1:
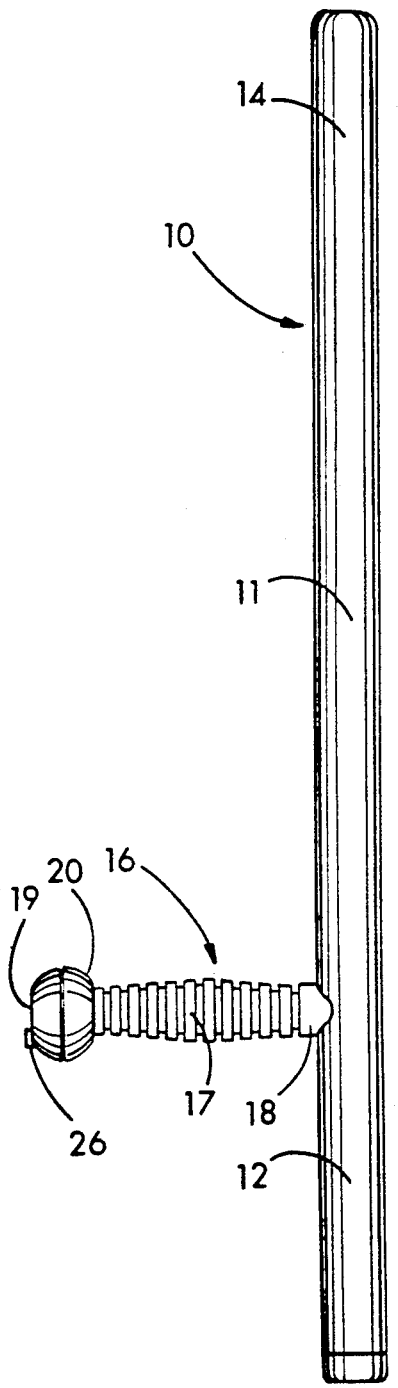
FIG. 1 is a side elevated view of a baton of the present invention illustrating the auxiliary folding handle in the perpendicular ready position.

In FIG. 1 there is illustrated a conventional police baton 10 as used in law-enforcement work. The baton 10 is generally an instrument having a shaft 11 with a diameter of approximately one and one-quarter inches and a length of approximately twenty-four inches. The baton can be made of a number of materials including wood, plastic, polycarbonate plastic, and metal. It is generally circular in cross section and includes a hand grip end 12 and a striking end 14. The baton 10 is generally held at the grip end 12 or auxiliary handle 16 and used in a sweeping or jabbing motion in order to combat an assailant.

Figure 1A:
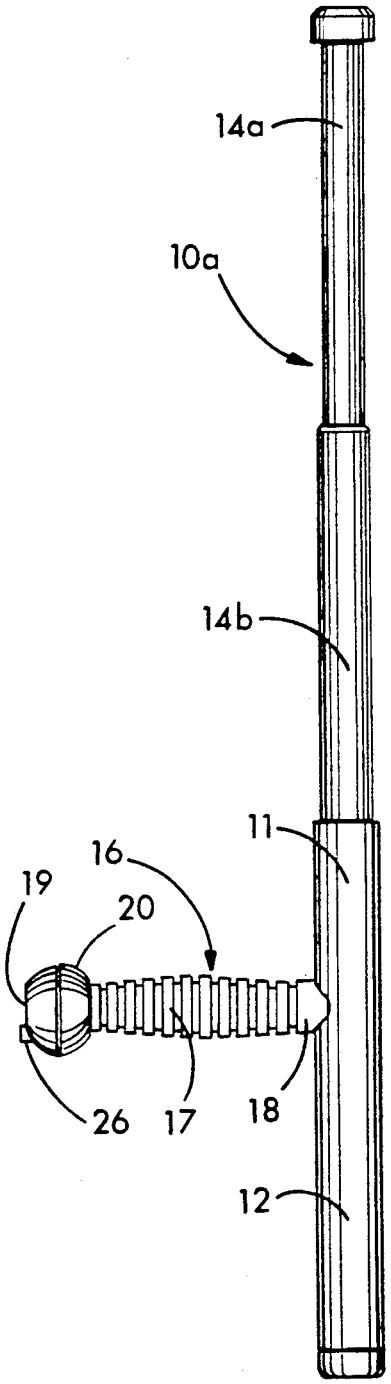
FIG. 1*a* is a side elevated view of an alternative embodiment of the baton of FIG. 1.

It is also within the scope of the present invention to utilize a telescoping baton 10*a*, illustrated in FIG. 1*a*. A description of a telescoping baton is found in Parsons U.S. Pat. No. 4,752,072, entitled "Telescoping Self-Defense Key Chain," which is incorporated herein by reference. Rather than a long single-piece shaft, such as illustrated in FIG. 1, a striking end 14 may include one or more telescoping members 14*a*, 14*b* slidably disposed within the grip end 12. In the retracted position, the baton 10*a* will be approximately one-third to one-fourth its extended length. The telescoping members may then be extended and locked in the extended position in order to increase the overall length of the baton for normal use.

With reference specifically now to FIGS. 1 and 1*a*, the baton is shown with an auxiliary handle 16 according to the present invention. The handle 16 is preferably formed with a gripping surface 17 of ridges or grooves to deter hand slippage during use. Alternatively, other gripping surfaces such as foam, rubber or cork may be used.

In the "ready" position, in which the auxiliary handle 16 is positioned for use, the handle 16 is attached to the baton at a right angle at a location approximately six inches from the end of the grip end 12. The auxiliary handle 16 includes a concave or saddle-shaped first end 18, composed of opposing wing members 21 and a channel 23, to mate the auxiliary handle 16 to the shaft 11 of the baton 10 when the longitudinal axes of the handle 16 and the shaft 11 are perpendicularly positioned. Located at the opposite second end 19 of the auxiliary handle 16 is preferably an enlarged knob 20 to further assist in resisting the hand's tendency to slip from the handle 16. The knob 20 of the handle 16 also includes a lock release button 26 to assist in releasing and folding the auxiliary handle 16 in a manner to be explained hereinafter.

Figure 2:
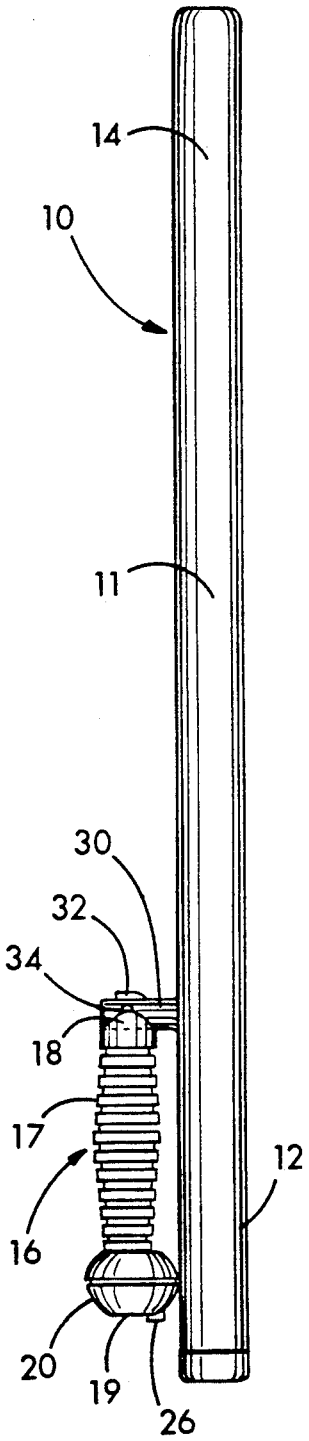
FIG. 2 is a side elevated illustration of the baton of FIG. 1 in which the folding handle is in the folded state.

Referring now to FIG. 2, there is illustrated the baton 10 in which the auxiliary handle 16 is in its released and folded position. In this figure, there is also illustrated a mounting post 30, which serves to attach the handle 16 to the shaft 11 of the baton 10. The mounting post 30 is hingedly attached to a handle post 32 by a hinge pin 34. Thus there is illustrated in FIG. 2 the baton 10 with a folded auxiliary handle 16.

Figure 3:
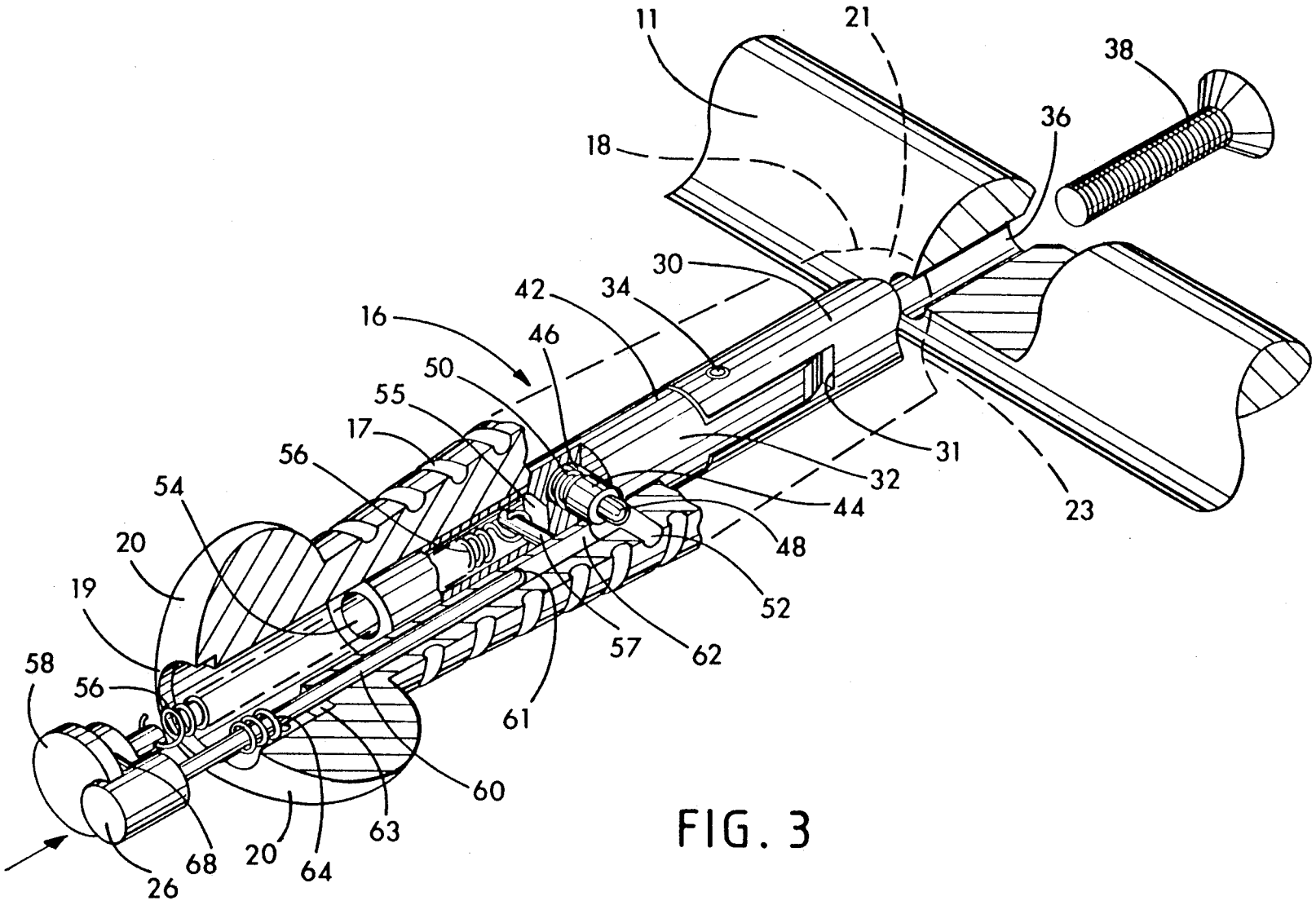
FIG. 3 is an exploded, perspective and partial cross-sectional view of the folding handle of the present invention.
Figure 4:
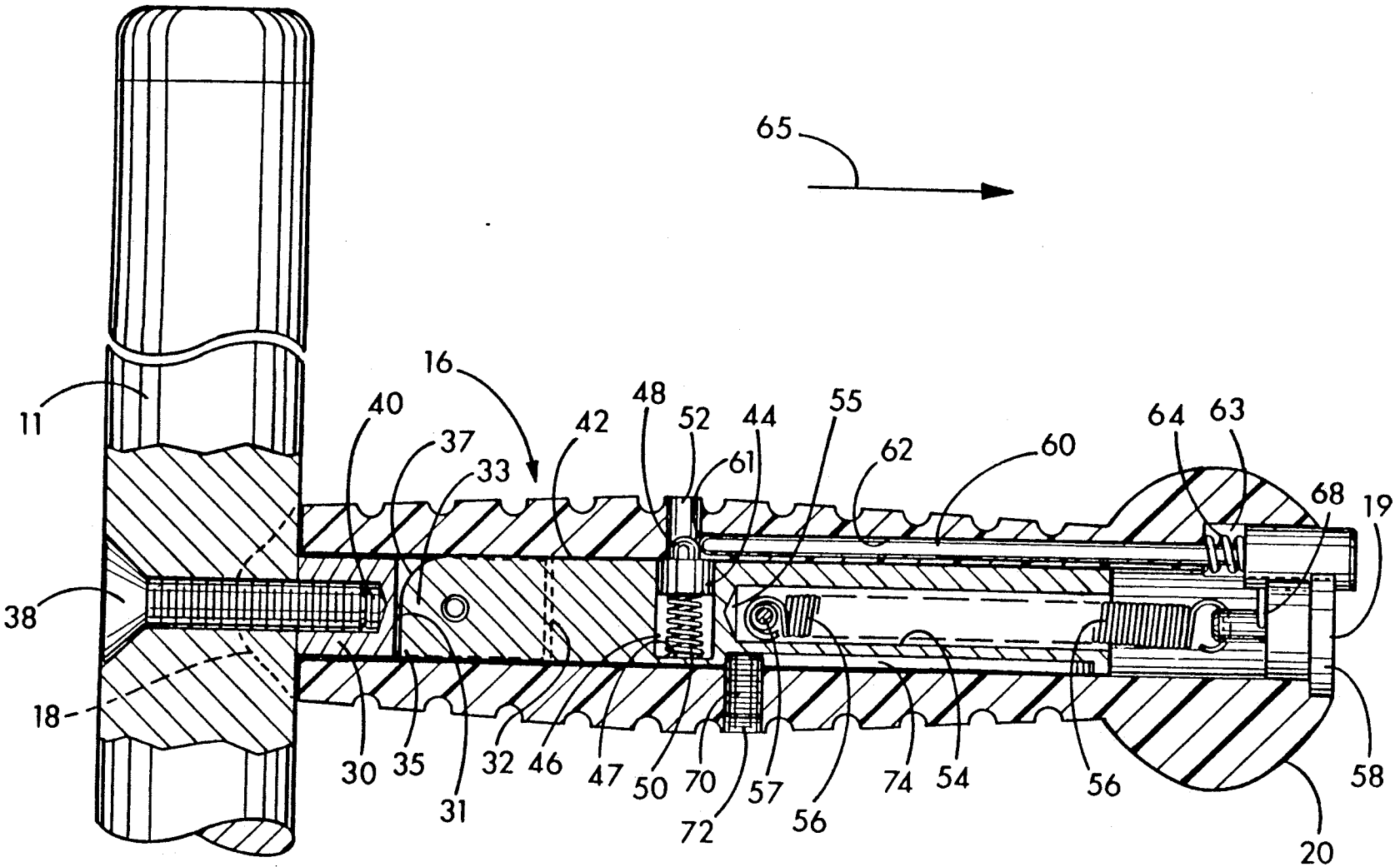
FIG. 4 is a side cross-sectional view of the folding handle of the present invention in its perpendicular or ready position.
Figure 5:
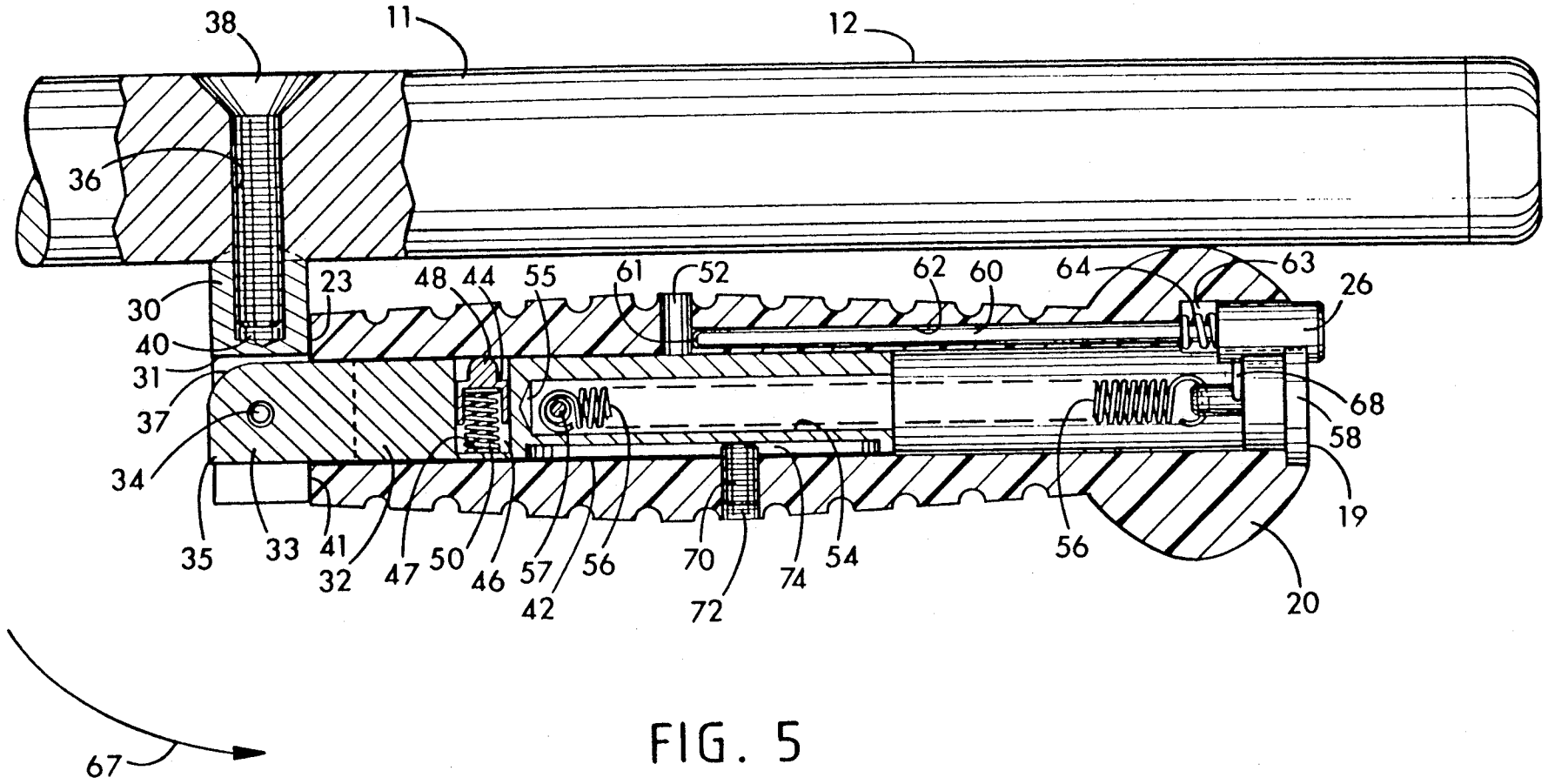
FIG. 5 is a side cross-sectional view of the auxiliary folding handle of the present invention in the folded state.

Referring now to FIGS. 3-5, there is illustrated the internal mechanisms of the handle 16 necessary for effecting the folding operation of the handle. The folding mechanism includes the mounting post 30 to which is hingedly attached the handle post 32 by means of the hinge pin 34.

The mounting post 30 is attached to the shaft 11 of the baton 10 by a variety of means known to the art. As illustrated in FIGS. 3 and 5, there is a radially extended opening 36 through the shaft 11, through which a retaining bolt 38 is placed. The bolt 38 co-acts with a threaded chamber 40 in the mounting post 30 in order to tighten the shaft 11 to the auxiliary handle 16. Alternatively, the mounting post 30 can be welded or otherwise fixedly attached to the shaft 11 of the baton 10. The auxiliary handle 16 includes an axially extended bore 42 through which the mounting post 30 and handle post 32 are positioned.

The present invention also contemplates a handle in which the axially extended bore 42 is positioned within a preformed tube. The tube includes all of the actuating mechanisms described herein. The gripping portion of the handle could then be injection molded or otherwise placed over the tube to form the complete auxiliary handle system.

In the activated position, as illustrated in FIG. 4, the auxiliary handle 16 maintains its perpendicular placement with respect to shaft 11 of the baton 10 by a lock composed of a biased retainer pin 44. The retainer pin 44 is located in a chamber 46 of the handle post 32 at a position approximately centered to the handle 16. The retainer pin 44 includes a protrusion or nipple 48. Located between the bottom wall 47 of the chamber 46 and the retainer pin 44 is a first biasing means such as a coiled spring 50, designed to give the retainer pin 44 an outward thrust. In use, the spring 50 urges the retainer pin 44 along the wall of the shaft bore 42. Located in the shaft bore 42 is an opening 52 just large enough to receive the nipple 48 of the outward thrusting retainer pin 44. When the nipple 48 is in the opening 52, the auxiliary handle 16 is secured in a perpendicular or activated position adjacent the shaft 11 of the baton 10.

The handle post 32 further includes a longitudinal pocket 54, which is designed to receive a second biasing means such as a retaining spring 56. The retaining spring 56 is secured at one end to the handle post 32 near the bottom wall 55 of the longitudinal pocket 54 preferably by a pin 57. The retaining spring is attached at the other end to a removable cap 58 in such a manner that the inward directed force of the spring 56, created by the tension of the spring, maintains the cap 58 within a defined location on the second end 19 of the auxiliary handle 16.

As mentioned previously, the second end 19 also includes a lock release button 26, which is attached to an elongated lock release pin 60. The lock release pin 60 traverses the auxiliary handle 16 in a supplemental axially extended tubular opening 62, which diameter is sufficiently large enough to slidably receive the lock release pin 60, such that the end 61 of the pin 60 opposite the lock release button 26 is located adjacent the nipple 48 of the retainer pin 44.

The tubular opening 62 has a widened mouth portion 63 to accommodate the increased diameter of the lock release button 26. Thus, the auxiliary folding handle 16 of the present invention can be releasibly locked into a perpendicular position with respect to the shaft 11 of the baton 10. A third biasing means, such as a spring 64, is positioned in the mouth 63 to urge to lock release button outwardly. The lock release button 26 is also defined by a retaining pin 68, which is fixedly attached to the button 26 and is urged against the cap 58 in order to prevent the removal of the outwardly-biased button 26 from the handle 16.

The hinge or folding mechanism will be described next. For ease of use and for safety, the folding mechanism includes a blocking feature to prevent the handle attachment from rotating in any direction except alongside the grip end 12 of the shaft 11. The mounting post 30 is provided with a generally squared end 31 which is located contiguous to the hinged end 33 of the handle post 32.

As illustrated in FIG. 4, the hinged end 33 of the handle post 32 is made such that one corner 35 is substantially squared while the other corner 37 is rounded. As will be explained with reference to FIG. 5, the purpose of this shape is to allow the auxiliary folding handle 16 to fold in one direction only. Additionally, the structure of the hinge maintains the folded handle 16 biased against the baton 10 such that the handle 16 will not inadvertently swing to its activated position.

Reference is now made to FIG. 5, which illustrates the embodiment of FIG. 4 in a folded state, in which the auxiliary handle 16 is folded alongside the grip end 12 of the baton 10. To fold the auxiliary handle 16 alongside the baton 10, as illustrated in FIG. 5, the lock release button 26 is depressed. Depressing the lock release button 26 causes the end 61 of the lock release pin 60 to act against the nipple 48 of the retainer pin 44 and causes the retainer pin 44 to be depressed from the opening 52 to the chamber 46 such that the nipple end 48 is adjacent the outside wall of the handle post 32. The auxiliary handle 16 is then grasped by the user's hand and pulled away from the shaft 11 of the baton 10 along the direction of the arrow 65, as illustrated in FIG. 4. Due to the opposing resistance of the retaining spring 56, the auxiliary handle 16 must be forced in this direction.

The auxiliary handle 16 is pulled such that the saddle end 18 is positioned just beyond the section 31 of the mounting post 30. Due to the squared shape of the end 31 and the rounded shape of corner 37 of the end 33 of the mounting post 30 and handle post 32 respectively, the auxiliary handle 16 may be folded in one direction only, i.e., the direction toward the rounded corner 37 of the hinged end 33, illustrated by arrow 67, such that the handle will come to a resting position adjacent the hand grip 12 of the baton 10.

When the handle 16 is folded alongside the shaft 11 of the baton 10, there is a tension created which acts to keep the handle 16 biased alongside the shaft 11. This tension is created by the channel 23 of the saddle-shaped first end 18, which creates a point of resistance or bias, due to the tension created by biasing spring 56, against the side of the mounting post 30 at 41 when the handle 16 is folded. This "point of resistance" acts as a spring-like catch urging the folded handle 16 against the baton and preventing the handle 16 from inadvertently swinging away from the shaft 11. In this manner, a slight force must be imposed on the handle 16 in order to place the handle 16 in perpendicular position with respect to the shaft 11.

In order to reactivate the handle 16, i.e., to place it in the perpendicular position, the handle 16 is gripped in one hand and the gripping end 12 of the baton 10 gripped in the other hand. The auxiliary handle 16 is then rotated approximately 90° in the opposite direction of arrow 67 until the mounting post 30 and the handle post 32 are in linear alignment as illustrated in FIGS. 3 and 4. At that position, the retaining spring 56 acts on the auxiliary handle 16 to force the auxiliary handle 16 to nest the saddle end 18 adjacent the shaft 11 of the baton 10, as illustrated in FIGS. 1 and 4. The nipple 48 will then be urged into alignment with the opening 52, thus displacing the end of the locking pin 60, which will in turn place the lock release button 26 in the up or ready position.

The auxiliary handle 16 is provided with a retaining feature to prevent the inadvertent slippage of the handle from the handle post and to assist the disassembly of the handle for repairs and cleaning. As illustrated in FIG. 5, the retaining feature may include a set screw 70 threadably positioned in a threaded opening 72. The handle post 32 is provided with a channel 74 having a width larger than the diameter of the set screw 70 and a length sufficient to allow the handle 16 to be pulled in such a manner so as to be folded, and to prevent the handle 16 from being completely removed from the handle post 32 when the set screw 70 is threadably inserted into the channel 74.

If the auxiliary handle is desired to be cleaned, the assembly is readily dismantled by removing the set screw 70 from the channel 74, releasing the retaining pin 44 from the opening 52, releasing the retaining spring 56 and pulling the handle 16 off the handle post 32.

Figure 6:
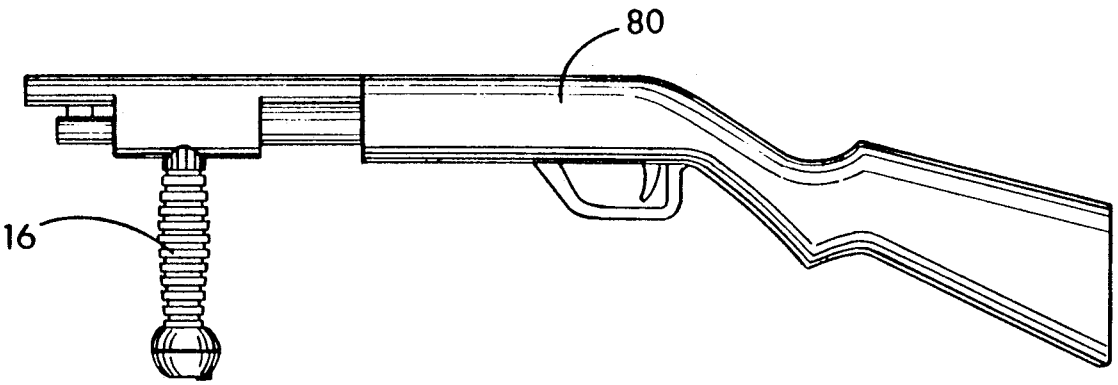
FIG. 6 is a side elevated view of an alternative embodiment of the present invention showing an auxiliary folding handle of the present invention in its activated position on a firearm, such as a short-barrelled shotgun.
Figure 7:
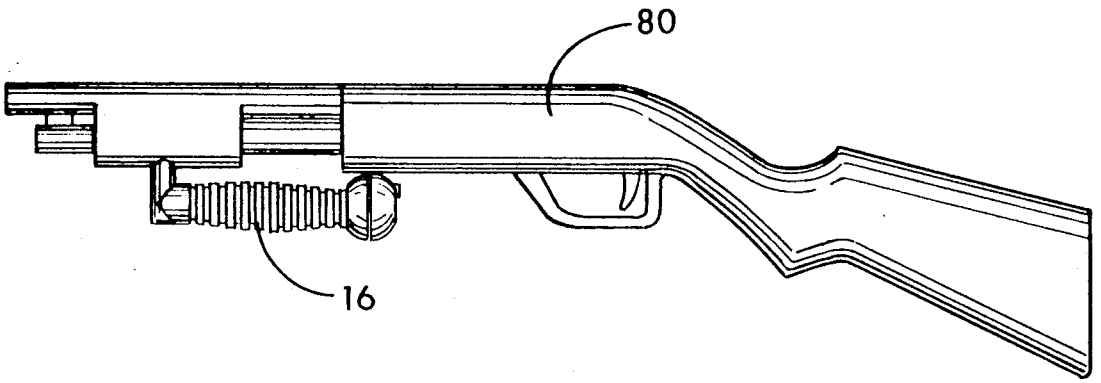
FIG. 7 is a side elevated view of the embodiment illustrated in FIG. 6 which the auxiliary folded handle is in the folded state.

Referring now to FIGS. 6 and 7, there is illustrated an alternative embodiment of the auxiliary handle 16 of the present invention. In this embodiment, the auxiliary handle 16 is placed for use on a firearm 80 in the ready position as illustrated in FIG. 6 or in the folded position as illustrated in FIG. 7. It is within the scope of the present invention to include many types of firearms, such as short-barrelled shotguns, submachine guns, pistols and rifles within the term firearm 80. The auxiliary handle 16 is operated in the same manner as described above.

Various alternatives and embodiments are contemplated as being within the scope of the following claims particularly pointing out and distinctly claiming the subject matter regarded as the invention.

What is claimed is:

1. An auxiliary folding handle attachment for an elongated shaft having a longitudinal axis, a first gripping end and a second end, the folding handle attachment comprising:

a. a handle having a first end for fitting against the shaft, a second exterior end, and an axially aligned bore extending therethrough;

b. a rod centrally disposed within the bore of the handle, the rod including a stationary mounting post with a first end for fitting against the shaft and a second end, and a handle post having a first end hingedly attached to the second end of the mounting post and a second end for securing the handle to the rod; and c. a lock for releasibly locking the handle attachment to the elongated shaft at a position perpendicular to the elongated shaft.

2. The handle attachment of claim 1 wherein the first end of the handle is molded for form fitting against the shaft.

3. The handle attachment of claim 2 wherein the first end of the handle is saddle-shaped.

4. The handle attachment of claim i wherein the shaft is a police baton, club or firearm.

5. The handle attachment of claim 1 wherein the shaft comprises at least one telescoping member.

6. The handle attachment of claim 1 wherein the lock comprises a biased retainer pin positioned in a chamber of the handle post and an aligned opening in the handle such that the retainer pin is at least partially biased into the opening in order to lock the handle in perpendicular position with respect to the shaft.

7. The handle attachment of claim 6 wherein the lock comprises a lock release mechanism.

8. The handle attachment of claim 7 wherein the lock release mechanism comprises a. a lock release pin slidably disposed within an auxiliary bore in the handle and having a first end and a second end, wherein the first end is biased at the second, exterior end of the handle and the second end is positioned adjacent the retainer pin such that the handle may not be folded unless the lock release pin is activated; and b. biasing means for maintaining the first end of the handle perpendicularly urged against the shaft, such that the lock release pin must be activated and the handle must be urged against the forces of the biasing means in order to fold the handle.

9. The handle attachment of claim 1 wherein the mounting post is releasibly attached to the elongated shaft.

10. The handle attachment of claim 1 wherein the mounting post is fixedly attached to the elongated shaft.

11. The handle attachment of claim 1 further comprising a biased connection between the second end of the handle and the second end of the handle post to provide sufficient resistance between the handle post and the handle in order to maintain the handle attachment in proper folded alignment with respect to the shaft.

12. The handle attachment of claim 1 wherein the hinged attachment of the handle and mounting post comprises means to prevent the handle attachment from rotating in any direction except alongside the first gripping end of the shaft.

13. A policeman's baton, comprising:

a. an elongated shaft having a longitudinal axis, a first gripping end and a second end;

b. a handle having a first end for fitting against the shaft at a position near the gripping end, a second exterior end, and an axially aligned bore extending therethrough;

c. a rod centrally disposed within the bore of the handle, the rod including a stationary mounting post with a first end for fitting against the shaft and a second end, and a handle post having a first end hingedly attached to the second end of the mounting post and a second end for securing the handle to the rod; and d. a lock for releasibly locking the handle attachment to the elongated shaft at a position perpendicular to the elongated shaft.

14. The baton of claim 13 wherein the lock comprises a biased retainer pin positioned in a chamber of the handle post and an aligned opening in the handle such that the retainer pin is at least partially biased into the opening in order to lock the handle in perpendicular position with respect to the shaft.

15. The baton of claim 14 wherein the lock comprises a lock release mechanism.

16. The baton of claim 15 wherein the lock release mechanism comprises:

a. a lock release pin slidably disposed within an auxiliary bore in the handle and having a first end and a second end, wherein the first end is biased at the second, exterior end of the handle and the second end is positioned adjacent the retainer pin such that the handle may not be folded unless the lock release pin is activated; and b. biasing means for maintaining the first end of the handle perpendicularly urged against the shaft, such that the lock release pin must be activated and the handle must be urged against the forces of the biasing means in order to fold the handle.

17. The baton of claim 13 further comprising a biased connection between the second end of the handle and the second end of the handle post to provide sufficient resistance between the handle post and the handle in order to maintain the handle attachment in proper folded alignment with respect to the shaft.

18. The baton of claim 13 wherein the hinged attachment of the handle and mounting post comprises means to prevent the handle attachment from rotating in any direction except alongside the first gripping end of the shaft.

* * * * *